US005514442A

United States Patent [19]

Galda et al.

[11] Patent Number: 5,514,442

[45] Date of Patent: May 7, 1996

[54] SEALING MEMBER FOR A CONTAINER

[75] Inventors: Michael P. Galda, Acton; Brian M. Klassen, Burlington; Stephen H. Witt, Smithville, all of Canada

[73] Assignee: Stanpac, Inc., Smithville, Canada

[21] Appl. No.: 152,103

[22] Filed: Nov. 15, 1993

Related U.S. Application Data

[63] Continuation of Ser. No. 681,040, Apr. 5, 1991, abandoned, which is a continuation-in-part of Ser. No. 530,536, May 30, 1990, abandoned, which is a continuation of Ser. No. 162,787, Mar. 2, 1988, Pat. No. 4,961,986.

[30] Foreign Application Priority Data

Sep. 9, 1987 [CA] Canada ..... 546450

[51] Int. Cl.[6] ..... B32B 7/06

[52] U.S. Cl. ..... 428/78; 215/232; 215/305; 215/350; 428/200; 428/201; 428/344; 428/349; 428/354

[58] Field of Search ..... 420/200, 201, 420/344, 351, 354, 347, 349, 78; 156/291; 215/232, 250, 305, 350

[56] References Cited

U.S. PATENT DOCUMENTS

| | | | |
|---|---|---|---|
| 713,824 | 11/1902 | White | 215/298 |
| 745,195 | 11/1903 | Kimsey | 215/298 |
| 756,601 | 4/1904 | Doremus | 215/298 |
| 830,735 | 9/1906 | Olsson | 215/298 |
| 895,719 | 8/1908 | Bradley | 215/298 |
| 902,843 | 11/1908 | Sheppard | 215/298 |
| 1,073,071 | 9/1913 | Hall | 215/298 |
| 2,050,248 | 8/1936 | Eisen | 154/45.5 |
| 2,077,992 | 4/1937 | Eisen . | |
| 2,079,757 | 5/1937 | Berk . | |
| 2,131,775 | 10/1938 | Waring . | |
| 2,152,012 | 3/1939 | Albion . | |
| 2,188,946 | 2/1940 | Gutmann . | |
| 2,620,939 | 12/1952 | Weisgerber . | |
| 2,646,183 | 7/1953 | Pellett . | |
| 2,653,888 | 9/1953 | Hyman, Jr. . | |
| 2,937,481 | 5/1960 | Palmer | 53/39 |
| 3,032,225 | 5/1962 | Harding | 215/250 |
| 3,202,308 | 8/1965 | Botkin . | |
| 3,317,068 | 5/1967 | Betner | 215/305 |
| 3,330,720 | 7/1967 | Stevens et al. . | |
| 3,389,827 | 6/1968 | Abere et al. . | |

(List continued on next page.)

FOREIGN PATENT DOCUMENTS

| | | |
|---|---|---|
| 0040797A1 | 2/1981 | European Pat. Off. . |
| 0057436 | 11/1982 | European Pat. Off. . |
| 0109592 | 5/1984 | European Pat. Off. . |
| 0109593 | 5/1984 | European Pat. Off. . |
| 0111900A2 | 6/1984 | European Pat. Off. . |
| 0128434A2 | 12/1984 | European Pat. Off. . |
| 0135431 | 3/1985 | European Pat. Off. . |
| 1343328 | 1/1963 | France . |
| 2327161 | 5/1977 | France . |
| 1916954 | 11/1969 | Germany . |
| 3212990 | 4/1982 | Germany . |
| 209616 | 4/1940 | Switzerland . |
| 565079 | 8/1975 | Switzerland . |
| 659633 | 2/1987 | Switzerland . |
| 283050 | 1/1928 | United Kingdom . |
| 2072131 | 9/1981 | United Kingdom . |
| 2203416 | 10/1988 | United Kingdom . |
| WO98/02402 | 3/1989 | WIPO . |

OTHER PUBLICATIONS

Leaflet entitled STANPAC—one page.

*Primary Examiner*—Jenna L. Davis
*Attorney, Agent, or Firm*—Birch, Stewart, Kolasch & Birch

[57] ABSTRACT

A sealing member for a container has a membrane, e.g., aluminum foil, and a first sheet, e.g. polyester, part of which is bonded to the membrane. The other part of the sheet is free, so as to form a tab having one of a number of possible profiles, to enable the sealing member to be detached as a single unit. At least part of the periphery of the tab is within the periphery of the membrane, to facilitate grasping of the tab. The first sheet and the membrane or foil may have a common periphery where they are bonded together.

31 Claims, 3 Drawing Sheets

U.S. PATENT DOCUMENTS

| | | | |
|---|---|---|---|
| 3,391,847 | 7/1968 | Christine et al. . | |
| 3,411,419 | 11/1968 | Becker et al. . | |
| 3,489,307 | 1/1970 | Wenger . | |
| 3,501,042 | 3/1970 | Risch et al. . | |
| 3,549,440 | 12/1970 | Adcock et al. . | |
| 3,565,247 | 2/1971 | Brochman . | |
| 3,632,004 | 1/1972 | Grimes | 215/40 |
| 3,637,101 | 1/1972 | Risch . | |
| 3,900,125 | 8/1975 | Wyler et al. | 215/341 |
| 3,923,198 | 12/1975 | Brochman . | |
| 3,963,845 | 6/1976 | Dukess . | |
| 3,964,415 | 6/1976 | Viker et al. . | |
| 3,990,603 | 11/1976 | Brochman | 220/260 |
| 4,044,941 | 8/1977 | Knudsen | 229/43 |
| 4,065,908 | 1/1978 | Mueller . | |
| 4,108,330 | 8/1978 | Patterson | 220/260 |
| 4,125,985 | 11/1978 | Laske . | |
| 4,135,637 | 1/1979 | Hannula . | |
| 4,155,439 | 5/1979 | Fletcher | 198/339 |
| 4,163,506 | 8/1979 | Patterson . | |
| 4,189,060 | 2/1980 | Trotman, III . | |
| 4,209,126 | 6/1980 | Eligs | 229/43 |
| 4,215,791 | 8/1980 | Brochman . | |
| 4,256,528 | 3/1981 | Patterson . | |
| 4,324,601 | 4/1982 | Dembicki et al. | 159/69 |
| 4,328,905 | 5/1982 | Hardt . | |
| 4,372,460 | 2/1983 | Brochman et al. . | |
| 4,373,978 | 2/1983 | Patterson . | |
| 4,378,074 | 3/1983 | Brochman . | |
| 4,390,552 | 6/1983 | Niwa . | |
| 4,405,056 | 9/1983 | Patterson . | |
| 4,418,834 | 12/1983 | Helms et al. | 220/359 |
| 4,423,819 | 1/1984 | Cummings | 215/232 |
| 4,424,911 | 1/1984 | Resnick . | |
| 4,436,213 | 3/1984 | Paul, Jr. et al. . | |
| 4,442,129 | 4/1984 | Niwa et al. | 429/399 |
| 4,445,620 | 5/1984 | Brochman et al. . | |
| 4,448,326 | 5/1984 | Brochman . | |
| 4,452,842 | 6/1984 | Borges et al. | 428/195 |
| 4,454,956 | 6/1984 | Patterson . | |
| 4,462,502 | 8/1984 | Luenser | 215/329 |
| 4,469,754 | 9/1984 | Hoh et al. . | |
| 4,500,011 | 2/1985 | Brochman . | |
| 4,501,371 | 2/1985 | Smalley | 215/232 |
| 4,514,248 | 4/1985 | Cummings | 156/268 |
| 4,523,689 | 6/1985 | Laub . | |
| 4,526,562 | 7/1985 | Knudsen et al. . | |
| 4,527,703 | 7/1985 | Cummings | 215/232 |
| 4,537,327 | 8/1985 | Lu . | |
| 4,557,505 | 12/1985 | Schaefer et al. . | |
| 4,564,121 | 1/1986 | Brochman . | |
| 4,565,738 | 1/1986 | Pardy . | |
| 4,576,297 | 3/1986 | Larson | 212/250 |
| 4,577,777 | 3/1986 | Brochman . | |
| 4,579,240 | 4/1986 | Ou-Yang | 215/230 |
| 4,588,099 | 5/1986 | Diez | 215/232 |
| 4,588,465 | 5/1986 | Paciorek | 156/220 |
| 4,595,114 | 6/1986 | Lu . | |
| 4,595,434 | 6/1986 | Eckstein et al. . | |
| 4,596,338 | 6/1986 | Yousif . | |
| 4,602,971 | 7/1986 | Bergeron et al. . | |
| 4,625,875 | 12/1986 | Carr | 215/232 |
| 4,650,082 | 3/1987 | Paciorek . | |
| 4,666,052 | 5/1987 | Ou-Yang | 215/230 |
| 4,673,601 | 6/1987 | Lamping et al. . | |
| 4,684,554 | 8/1987 | Ou-Yang . | |
| 4,693,390 | 9/1987 | Hekal . | |
| 4,697,719 | 10/1987 | Allen . | |
| 4,722,447 | 2/1988 | Crisci | 215/232 |
| 4,733,786 | 3/1988 | Emslander . | |
| 4,735,335 | 4/1988 | Torterotot | 220/270 |
| 4,754,890 | 7/1988 | Ullman | 215/232 |
| 4,757,914 | 7/1988 | Roth et al. . | |
| 4,762,246 | 8/1988 | Ashley | 220/270 |
| 4,767,016 | 8/1988 | Cook, Jr. et al. | 215/230 |
| 4,778,069 | 10/1988 | Keller . | |
| 4,778,698 | 10/1988 | Ou-Yang | 428/35 |
| 4,801,041 | 1/1989 | Takata et al. . | |
| 4,810,541 | 3/1989 | Newman et al. . | |
| 4,872,571 | 10/1989 | Crecelius et al. . | |
| 4,961,986 | 10/1990 | Galda | 428/349 |
| 5,004,111 | 4/1991 | McCarthy . | |
| 5,012,946 | 5/1991 | McCarthy . | |
| 5,119,964 | 6/1992 | Witt . | |
| 5,270,093 | 12/1993 | Galda et al. . | |

SEALING MEMBER FOR A CONTAINER

This application is a continuation of application Ser. No. 07/681,040, now abandoned filed Apr. 15, 1991 which is turn is a continuation-in-part of a co-pending application Ser. No. 530,536 filed on May 30, 1990, now abandoned which is a continuation of Ser. No. 07/162,787 filed on Mar. 2, 1988, now U.S. Pat. No. 4,961,986. The disclosure of the continuation application, Ser. No. 530,536, is hereby incorporated by reference.

FIELD OF THE INVENTION

This invention relates to a sealing member or closure for a container, and more particularly is concerned with a sealing member that includes a tab having one of a number of possible profiles to facilitate removal of the sealing member.

BACKGROUND OF THE INVENTION

There are known for a wide variety of containers, various seals or closures which are sealed to the container around an opening to close the opening. To open the container, the seal has to be broken, providing an indication that the container has been opened, or possibly tampered with. Such seals or closures are used in a wide variety of containers, e.g. bottles of pharmaceuticals, foods, beverages, etc. In some cases their primary function is to provide an element of security, and an indication if the contents have been tampered with. For foods, they are frequently used to seal the foods, so as to maintain the freshness of the food and prevent contamination of the food.

The following U.S. patents all relate in general terms to seals for containers, and were considered during the preparation of this application. U.S. Ser. Nos.:

713,824 (White)
745,195 (Kimsey)
756,601 (Doremus)
830,735 (Olsson)
895,719 (Bradley)
902,843 (Sheppard)
1,073,071 (Hall)
2,050,248 (Eisen)
2,937,481 (Palmer)
3,032,225 (Harding)
3,317,068 (Betner)
3,632,004 (Grimes)
3,900,125 (Wyler)
4,044,941 (Knudsen)
4,155,439 (Fletcher et al)
4,324,601 (Dembicki)
4,423,819 (Cummings)
4,442,129 (Niwa)
4,462,502 (Luenser)
4,469,754 (Hoh et al)
4,501,371 (Smalley)
4,514,248 (Cummings)
4,526,562 (Knudsen et al)
4,527,703 (Cummings)
4,576,297 (Larson)
4,579,240 (Ou-Yang)

4,588,099 (Diez)
4,625,875 (Carr)
4,666,052 (Ou-Yang)
4,722,447 (Crisci)
4,735,335 (Torterot)
4,754,890 (Ullman)
4,778,698 (Ou-Yang)

The following European patents and published specifications or applications were considered:

European patent 040,797
European published application 128,434
European published specification 135,431
Swiss patent 209,616
Swiss patent specification 659,633
British patent 283,050
British patent 2,072,131A
French specification 2,327,161

The seven earlier U.S. patents all relate generally to closures for bottles or containers including a shoulder or annular recess for a disk or card closure or the like, and many of them are particularly concerned with milk bottles. Some of these patents show tabs for assisting removal of the closure, but in general the structures are not suitable for simple, economical mass production, and they are not concerned with seals that can be bonded to the neck of a bottle.

In the White patent, a strip is secured to the disk closure by paste and its ends form tabs for removal of it.

U.S. Pat. No. 745,195 discloses a closure provided with an upper disk secured to the main disk and having a segment removed so it can be grasped. The drawings show a staple securing the two parts together.

U.S. Pat. No. 756,601 forms a tab by folding a single sheet of a certain shape.

In U.S. Pat. No. 830,735, there is disclosed a closure in which an upper disk is mounted over a lower disk and is larger. It does not teach or suggest a tab whose free edge is within the periphery of the lower disk. Whilst it is suggested that any suitable fastening could be employed, only shellac or a staple are disclosed.

U.S. Pat. No. 895,719 discloses a bottle or jar closure including a liftable pull tab in the centre of the disk.

U.S. Pat. No. 902,843 is concerned with a disk provided with a thread for lifting the closure.

The Hall patent again discloses a milk bottle seal, which includes a central flap for lifting the seal. A disadvantage with such an arrangement is the difficulty of bonding the two layers together whilst leaving the flap free.

The Palmer U.S. Pat. No 2,937,418 is of some interest, as apparently being an early example of induction sealing of the closure to the neck of a bottle. However, it does not address the problem of providing any tab or the like to facilitate removal of the seal.

The Harding U.S. Pat. No. 3,032,225 discloses a combination closure which includes a tear-off cap. This is formed from thin aluminium and includes a tear-off tongue. No discussion is given as to how this would be formed. Experience with such tear-off tongues or tabs for aluminium foil closures indicates that they frequently do not function as intended. Often, instead of enabling the closure to be removed, a thin strip is torn from the middle of the closure.

The Betner U.S. Pat. No. 3,317,068 is concerned with tear-open sealed containers, and includes a multi-layer closure with a central pull tab.

The Grimes U.S. Pat. No. 3,632,004 tackles the problem of facilitating the removal of the closure or seal in a different manner. Here, a recess or notch is provided in the neck of the bottle, so that a portion of the closure overhangs it. This does not greatly facilitate removal of the closure. The user has to grasp a relatively small edge portion of the closure, and this is not practical for then flexible seals. However, the notch is relatively small in width, so that again there is the potential for a foil seal to be torn, rather than removed as a whole.

The Wyler patent discloses a container for a pharmaceutical or cosmetic product with a foil closing the opening. This includes a tear-off flap. However, no great details are given as to how this would be formed.

The Carr et al U.S. Pat. No. 4,625,875 is primarily concerned with a tamper-evident closure. It does show a foil disk provided with a tab. This tab has to be folded over within the cap. No details are given as to how this would be formed or assembled.

The Swiss patent specification 659,633 discloses a sealing cap unit for a container, however the tabs 17, 18 disclosed are for a different configuration than the applicants' invention. It does not disclose a tab profile wherein any portion of the free edge of the tab is inside or central to the periphery of the membrane to improve ease of use of the tab in separating the sealing member from the container it protects. In addition, the composite portion, i.e. the bonded area between the tab and the membrane is configured differently than in applicants' invention.

The Zweck form et al U.S. Pat. No. 4,155,439 should also be noted. This is the only patent that discusses in detail the production of a flexible end closure with a folded pull tab. As shown in this patent, complex machinery is required to form the closure and fit it to the container. A circular table or platform is provided, on which the containers are placed. The table is then rotated, to move each container through numerous different stations. At each station a different operation is performed. The closure itself is stamped from a strip of foil, and then the tab has to be folded up on top of the main portion of it. A complex sequence is required to mount the closure to the container. To set up such machinery for a particular production run is time consuming and expensive.

Additional problems are encountered with this sort of technique. Firstly, the presence of the inwardly folded tab can affect the sealing by means of induction heating. Induction heating relies upon the generation of currents and hence heat in the foil. The presence of the tab affects the electrical properties locally, and can result in improper sealing. As discussed in an article by Bill Zito in the August, 1986 issue of Food and Drug Packaging, the current tends to follow the actual periphery of the tab. Also, the folded tab can stick to the inside of the cap, which then requires a silicone liner or the like. Additionally, the induction sealing technique relies upon the fact that the foil closure is pressed against the neck of the container by the cap. With the folded tab present, there may not be even pressure applied to the foil closure, which again can result in imperfect sealing.

Even if proper sealing is achieved, the tab itself often does not provide for reliable opening of the container. Ideally, the tab and the whole circular foil closure should be removable as one piece. In practice, when the tab is lifted to detach the foil from the bottle or container neck, only the portion of the foil adjacent to the tab becomes detached from the container. Then, the tab simply pulls away a strip of foil across the container. This then leaves the user to manually remove the remaining pieces of the foil. For many uses, it is quite undesirable for the user to have to insert his or her fingers into the neck of the container, as this can result in contamination. Such uses could be pharmaceutical products, and food and beverages dispensed at restaurants.

As suggested by the Fletcher et al patent and many other earlier proposals, a common technique for sealing a foil to the neck of a container is by induction heating. This requires the foil sealing member or closure to be inserted into a cap. The cap is then fitted, usually by screwing onto the neck of the container, so as to press the foil against the neck of the container. The neck of the container is then passed through an induction heater, which induces currents in the foil, melting an appropriate adhesive on the foil, causing it to bond to the neck of the bottle. One step in this process is the fitting of the foil into the cap, and the subsequent fitting of the cap to the neck of the container. For this purpose, the foil closure by itself must be capable of being retained within the cap. For simple aluminium foil sealing members or closures this does not always work perfectly. Aluminium has plastic characteristics; in other words, when the foil is pressed into a screw cap, the edges of the foil can deflect permanently as they pass over the screw threads. The edges of the foil do not snap-back into the grooves of the screw thread. Consequently, the foil can drop out before the cap is fitted to the container neck.

The applicants displayed for the purpose of offering for sale an early version of the sealing member at a tradeshow in Chicago from September, 1987. It is believed that applicants' invention disclosed herein distinguishes patentably from the Chicago invention displayed in that the sealing member shown at the tradeshow contained no provision of a tab having a portion of its free edge' inside the periphery of the membrane to facilitate easier grasping of the tab by the user. If the tab free edge is wholly aligned with the membrane periphery or completely covers the membrane it is more difficult for a user to locate the edge of the tab to separate the tab and the membrane, which may result in use of a fingernail or knife to separate the edge of the tab, with the result that the user is delayed in removing the sealing member and there is a potential for puncture or incorrect removal of the sealing member. Further, a purely semicircular tab gives little indication as to the direction in which it should be pulled.

Accordingly, what is desired is a sealing member or closure which can be readily fitted to the neck of a container. It should be capable of being produced simply and economically on conventional machinery, without numerous complex forming operations. Ideally, it should be of uniform thickness throughout, and should be capable of uniform induction heating, so that it can be readily joined to the neck of a bottle by induction heating. Further, it is desirable that at least one edge portion should include elastic, as opposed to plastic properties, so that when inserted into a cap, it will snap-back into the grooves of the screw thread of the cap to retain the sealing member in position prior to induction heating and bonding. In addition, the tab profile should facilitate removal of the sealing member from the container.

BRIEF SUMMARY OF THE PRESENT INVENTION

In accordance with the present invention, there is provided a sealing member, adapted for securing to and closing an opening of a container to close the container, the sealing member comprising: a membrane having a periphery, one side of which is for bonding to the lip of a container; a first sheet; a first layer of adhesive between the membrane and the sheet bonding facing portions of the membrane and the first sheet together to form a composite portion whilst leaving at least one portion of the first sheet free in a separated portion of the sealing member, the free portion of the first sheet forming a tab, wherein a portion of the free edge of the tab is located inside the periphery of the membrane, wherein the composite portion extends up to a line extending across the membrane and wherein a part of the periphery of the membrane bounding that portion of the membrane forming the composite portion is common with a corresponding part of the first sheet; and an additional layer of adhesive on said one side of the membrane which is adapted for bonding to the lip of the container, with the first layer of adhesive bonding the first sheet and the membrane together so strongly that, in use, the first sheet and the membrane can be removed as a unit from the lip of the container, to open the container.

In accordance with the present invention, the first sheet and the membrane have a variety of additional characteristics, provided singularly or in combination. In one variation the area of the free portion of the first sheet is smaller than the area of the membrane which does not form part of the composite portion. In another variation two tabs are provided. In another variation, a portion of the periphery of the tab corresponds at least with the periphery of the membrane. By "corresponds" it is meant that the profile of the periphery of the first sheet is to at least some extent determined by the membrane periphery, without necessarily corresponding exactly with it; for example, the periphery of the first could have a similar profile in the composite portion but be located a uniform distance or spacing within the membrane periphery. In another variation, no portion of the tab periphery is common with the periphery of the tab. It will be appreciated that a variety of tab profiles are possible. Preferably though the width of a dividing line between the composite and separated portion is greater than the width of the tab. This is desirable, in view of the stresses that can arise at the dividing line, tending to separate the membrane and first sheet. In another variant, the composite portion covers a large portion of the membrane. In yet another variant, the sealing member is generally planar. In a further variant, the area of the composite portion is greater than the area of a perimeter portion of the membrane intended to be bonded to the lip of the container.

The sealing member may have the first layer of adhesive extending between opposite parts of the periphery of the membrane and up to a line extending across the membrane between ends of said opposite peripheral parts, the line separating the composite portion from the separated portion including a free tab. Also, a second sheet can be provided, secured to the first sheet by a further layer of adhesive to reinforce the first sheet. These features may be provided in various combinations.

In a preferred form of the invention, the sheet is bonded to the membrane across all of one side of the sheet up to the line, whilst the other side of the sheet forms a single tab. However, it is possible for the bonded portion of the sheet to be a central strip of the sheet, with a line on either side, so as to leave tabs on either side thereof. The tab or tabs can have any one of a number of possible profiles.

The surface of the membrane remote from the first sheet is coated with a layer of an adhesive. The term "adhesive" is used in the specification including the claims to mean any adhesive capable of bonding the membrane to the neck of a container, and includes thermoplastics and pressure-sensitive adhesives. Preferably, the adhesive is a hot melt bonding material, and in the specification, including the claims, a "hot melt bonding material" means a material which upon heating, for example as a result of induction heating of a metal membrane, melts, to enable the membrane to be bonded to the lip or neck of a container, and encompasses both thermoplastic materials and adhesives.

The present invention also provides a cap in combination with a sealing member as just defined.

DESCRIPTION OF THE DRAWING FIGURES

For a better understanding of the present invention, and to show more clearly how it may be carried into effect, reference will now be made, by way of example, to the accompanying drawings, which show preferred embodiments of the present invention, and in which.

DESCRIPTION OF THE PREFERRED EMBODIMENT

Figure 1:
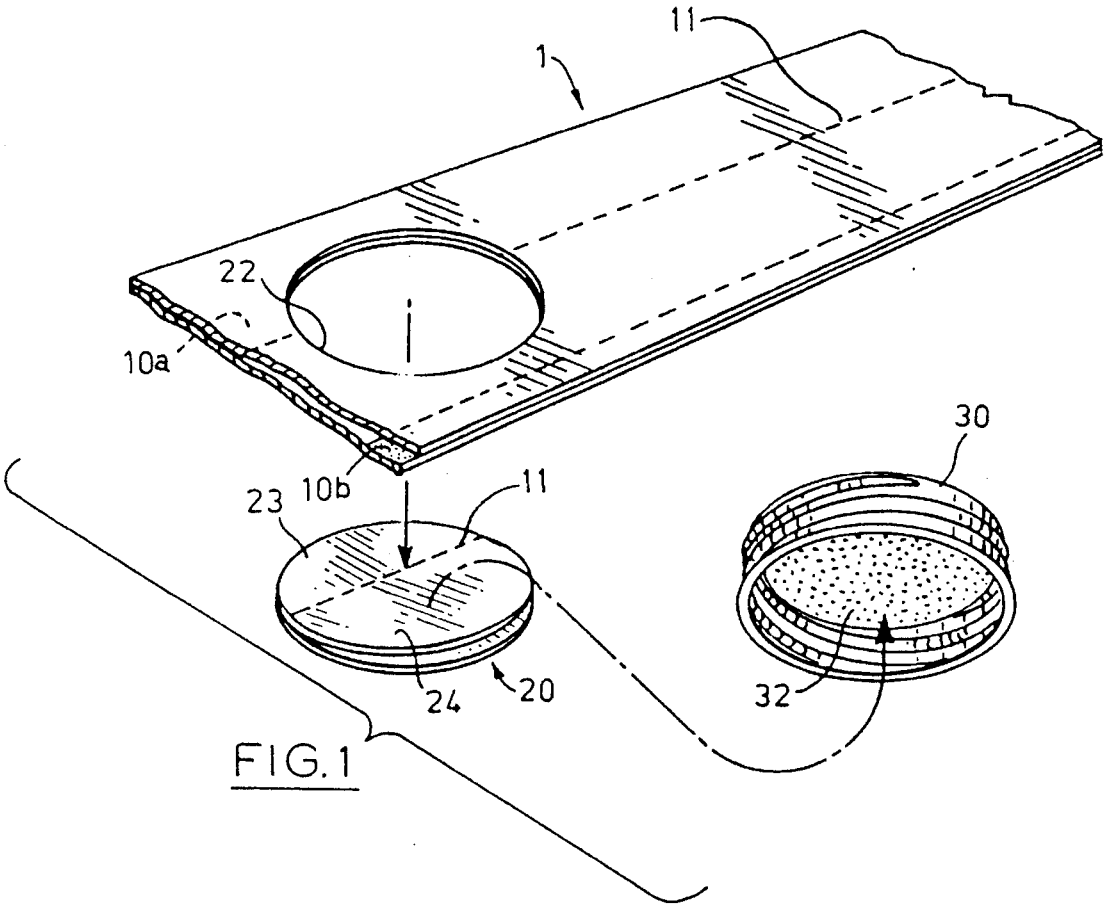
FIG. 1 is a perspective view of an elongate strip according to the present invention, showing a sealing member stamped from the strip and a corresponding cap.
Figure 4:
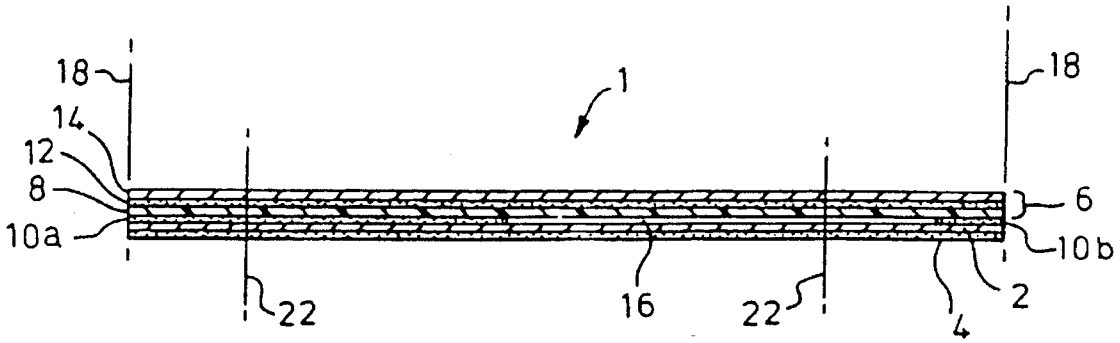
FIG. 4 is a sectional view perpendicular to the axis of the elongate strip of FIG. 1.

With reference to FIGS. 1 and 4, an elongate strip according to the present invention is designated by the numeral 1. As described in greater detail below, the elongate strip 1 can be of indefinite length, and can form part of a wider strip.

The elongate strip 1 has a membrane 2. A lower surface of the membrane 2 is coated with a hot melt bonding material or adhesive 4. A sheet 6 is a laminate sheet comprising a number of separate layers. The sheet 6 has a first sheet 8. Between the first sheet 8 and membrane 2, there is a first layer of adhesive 10. This layer of adhesive 10 does not extend across the full width of the strip 1, as detailed below.

A further layer of adhesive 12 is provided on top of the first sheet 8 and bonds a second sheet 14 to the first sheet 8.

The section through the elongate strip 1, shown in FIG. 4, is constant along its length (for clarity, the thickness of the various layer is amplified in FIG. 4). The first layer of adhesive 10 comprises two portions. A major portion, designated 10*a* extends along the left hand side of the strip as viewed in FIG. 4. A narrow portion 10*b* can extend along the right hand side of the strip 1, again as viewed in FIG. 4. This leaves a gap 16, where the membrane 2 and first sheet 8 are not bonded to one another.

In practice, the elongate strip 1 would be produced as part of a wider strip containing a number of the elongate strips 1. The edges of the elongate strip 1 are defined by the boundaries 18 in FIG. 4, and in the wider strip the elongate strips 1 would be continuous at their boundaries 18. Thus, the wide portion 10*a* would be continuous with the narrow portion 10*b* of an adjacent strip. Appropriate edge regions would be provided along either edge of the wider strip. Thus, typically to accommodate tolerances in the machinery, wider portions 10*a*, 10*b* would be provided along either edge of the wider strip.

Referring to FIG. 1, once the elongate strip has been formed, separate sealing members, designated 20 can be die cut from the strip. Each sealing member is die cut generally centrally from the elongate strip 1 as indicated by the vertical lines 22 in FIG. 4. The sealing member 20 is circular.

The adhesive portion 10*a* has a straight edge or line 11 which in the illustrated embodiment is straight bounding the gap 16. This line 11 extends approximately diametrically across the sealing member 20, as shown in FIG. 1.

The sealing member 20 thus includes a composite portion 23, and a separated portion 24 with the line 11 running between them. In the composite portion, the wide portion 10*a* of the first layer of adhesive results in the various layers being bonded together. In the separated portion 24, the laminate sheet 6 is separate and free from the membrane 2. It should be noted that the sealing member 20 is cut so as to be clear of the narrow portion 10*b* of the adhesive layer. The narrow portion 10*b* is included simply to hold the right hand edges of the membrane 2 and the laminate sheet 6 together to prevent them from flapping or becoming folded etc. In known manner, the various dimensions can be chosen so as to maximize the use of the material. Thus, the narrow portion 10*b* can be kept as narrow as possible, and the width of the strip 1 and the spacing of the sealing members along it can be selected to obtain the maximum number of sealing members 20.

Figure 5:
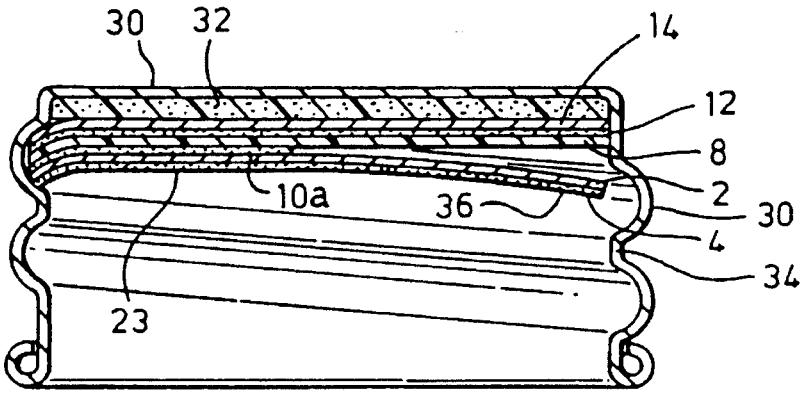
FIG. 5 is a sectional view through a cap fitted with a sealing member of the present invention.

With reference to FIG. 5, a cap for screwing onto a container is shown schematically at 30. The cap 30 is a screw cap, and here is shown as being formed with a uniform wall thickness throughout its planar top wall and cylindrical side wall having a screw thread 34. Within the cap 30, there is a disc 32 of expanded polystyrene or the like, so as to provide a resilient cushioning member. The sealing member 20 is pressed into the cap 30, and is shown in FIG. 5 with the composite and separated portions 23, 24 on the left hand and right hand sides of the figure respectively.

As detailed below, for this usage the membrane 2 is formed from aluminium foil, the first sheet 8 from polyester, and the second sheet 14 from paper.

As the sealing member 20 is pressed into the cap 30, the edges of the member 20 will ride over the ridges of the screw thread 34 of the cap 30. The resiliency of the sheet 8 is sufficient to overcome the properties of the membrane 2. The second sheet 14 does not greatly influence the resiliency of the sealing member 20. Consequently, as the edges of the sealing member 20 ride over the ridges 34, the periphery of the first sheet 8 deflects, but tends to spring back to maintain its planar configuration. When the sealing member 20 is fully inserted, as shown in FIG. 5, the composite portion 23 springs back to engage the grooves of the screw thread 34. Similarly, for the separated portion 24, the laminate sheet 6 springs back to engage the grooves of the screw thread. However, the membrane 2, of the separated portion 24 is not bonded to the sheet 8. Consequently, as it rides over the ridges 34 its edge deflects plastically, so as to be permanently deformed. This is indicated at 36. As a consequence, the membrane 2 in the separated portion 24 does not engage the screw threads. However, the engagement by the rest of the sealing member 20 holds the sealing member 20 in position.

Figure 2:
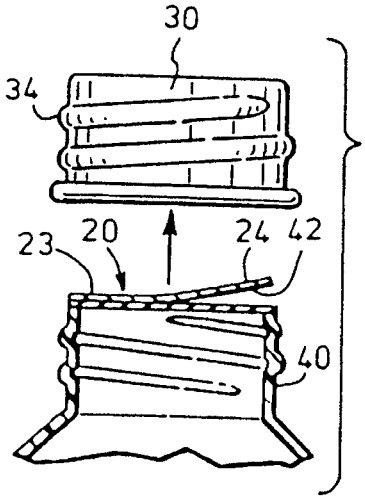
FIG. 2 is a side view showing a section through the neck of a container including a sealing member according to the present invention, and a cap shown removed.

The cap 30 is then screwed on the neck of a bottle, indicated at 40 in FIG. 2 after filling of the bottle or other container. The cap 30 is screwed on sufficiently, to press the sealing member 20 uniformly against the top of the neck 40. The deformed edge 36 is then pressed against the laminate sheet 6 and conforms to the neck of the container. As there is no tab or other feature providing a varying thickness in the sealing member 20, the disk 32 enables a uniform pressure to be applied over the sealing member 20, so that a uniform pressure should be applied at all points between the sealing member 20 and neck 40.

In known manner, the bottle neck 40 with the cap 30 is then passed through an induction heating apparatus. This uses high frequency fields to induce currents within the foil of the membrane 2. This heats the foil 2. The heat in turn causes the hot melt bonding material 4 to melt, and upon cooling, it bonds the membrane to the top of the bottle neck 40.

The bottle is then ready for distribution, sale, etc.

In use, to open the bottle, the user removes the screw cap 30 in the usual way. This then reveals the sealing member 20 bonded to the bottle 40. On one side, the laminated sheet 6 of the separated portion 24 forms a free tab 42. On the other side, the composite portion 23 is bonded to the bottle neck 40.

Figure 3:
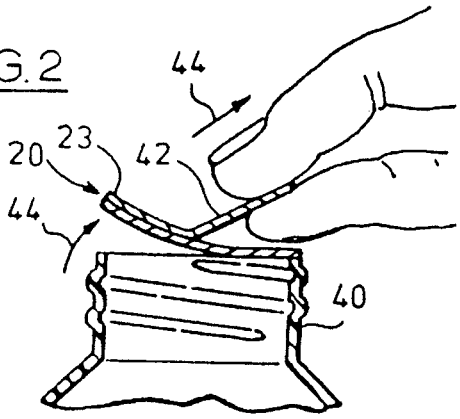
FIG. 3 is a sectional view of the neck of the container of FIG. 2, showing removal of the sealing member.

As shown in FIG. 3, the sealing member 20 can then be removed by grasping the tab 42. The tab 42 is grasped between two fingers and pulled in the direction of the arrows 44, i.e. the tab 42 is generally pulled laterally, rather than upwards. The composite portion 23 is then pulled from the bottle neck 40, commencing at the portion remote from the separated portion 24. Further pulling on the tab 42 causes complete detachment of the composite portion 23, followed by detachment of the separated portion 24, as the bond strength of the first layer of adhesive 10 is sufficiently great relative to the bond strength of the hot melt bonding material or adhesive 4 that the membrane 2 and the first sheet 8 are removable as a unit, as shown.

The tab 42 is pulled laterally, to make full use of the bond provided by the first layer of adhesive 10. If the tab 42 is pulled upwards, or away from the separated portion 24, there may be a tendency for the first layer of adhesive 10 to separate, depending upon the nature of the various materials used and bond strengths of the adhesive layers 4, 10. Pulling laterally causes the sealing member 20 to separate from the lip of the bottle neck 40 as a single unit to leave the neck 40 fully open.

With the bottle open, it can be reclosed if desired, with the cap 30 in known manner.

The preferred materials for the sealing member 20 are as follows. For the membrane 2, aluminium foil having a thickness of 0.0015 inches is used. The hot melt bonding material is adhesive no. H0466 supplied by Industrial Adhesives. The first adhesive layer 10 is a composite adhesive, namely, Spenbond adhesive 650/651, supplied by NL Chemicals; adhesive 650 is a water dispersed urethane-laminating adhesive, whilst 651 is a water dispersable curing agent for the adhesive. The first sheet 8 is a polyester, supplied by Dupont, having a thickness of 0.001 inches. The further adhesive layer is adhesive no. R0202, again supplied by Industrial Adhesives, this being a water born adhesive. Finally, the second sheet 14 is a bleached kraft paper having a thickness of 0.004 inches and a nominal weight of 52 pounds.

The top of the second sheet 14, which is formed from paper, is visible once the cap 30 has been removed from a bottle. Accordingly, it can be printed with suitable indicia. Thus, it can be printed with instructions, including arrows etc. indicating the direction in which the tab 42 is to be pulled. It can be printed with any other information desired, for example trade marks, logos, etc. identifying the product.

A preferred manufacturing sequence for producing the strips is as follows. For sealing members having a diameter of approximately 1⅜ inches, a wide strip is produced having a width of 21⅜ inches, including ten elongate strips 1. The wide strip is laminated together in the following sequence. The following discussion relates to the elongate stock for the membrane 2 and first sheet 8, rather than to the individual membrane 2 and first sheet 8 in a single sealing member 20.

First, the first and second sheets 8, 14 are laminated together. This is achieved by applying adhesive in known manner to one of the sheets and then pressing these two sheets together. This forms the laminated sheet 6. The next step is to dry bond the laminated sheet 6 to the metal foil or membrane 2. This is achieved by applying Spenbond 650/651 adhesive to the laminated sheet 6 (or alternatively to the foil 2), and allowing it to dry until tacky. The membrane or metal foil 2 is then applied. Heat and pressure are then applied to the composite strip, to re-activate the glue and cause the membrane to become bonded to the laminate sheet 6.

Now, it is necessary for the Spenbond adhesive, forming the first adhesive layer 10 to be only applied in strips. This is achieved by using a specially formed roller. The roller essentially comprises raised parts, of constant radius, and slightly recessed parts. Only the recessed parts contact and transfer glue. A doctor blade wipes the adhesive of the raised parts so that they do not transfer any adhesive. Thus, a sheet passed across the roller receives strips of glue, the roller is so dimmensioned as to apply the glue in the desired pattern.

The exposed surface of the membrane or foil 2 is then coated with a hot melt bonding material in the known manner.

The composite, wide strip is then formed. It is slit into the elongate strips 1 and printed. In a preferred embodiment, the wide strip having a width of 21⅜ inches is slit into three intermediate strips each including three elongate strips 1, and a separate single elongate strip 1. These three elongate strips and the single elongate strip 1 are then printed, prior to slitting each of the intermediate strips into three elongate strips 1.

In known manner, the various steps are carried out on continuous lengths of the membrane 2 and first and second sheets 8, 14. In general, after each step, the strip formed was rewound, prior to carrying out the next step. However, with suitable equipment, it may we be possible to carry out the various steps as a continuous operation.

Once the elongate strips 1 have been formed, the sealing member 20 are cut from them by die-cutting, so that the various layers have a common periphery. The dies are perfectly shaped, the cleanly cut the sealing members 20. Thus, the die is tapered and is deeper on the side for the separated portion 24.

Whilst the above description has been in relation to a circular sealing member 20, it is to be appreciated that many variations of the invention are possible. Thus, the sealing members need not necessarily be circular, but can be a variety of shapes, e.g. a rounded rectangle, depending upon the nature of the container and the shape of its opening. Additionally, the provision of the second sheet 14 and the corresponding layer of adhesive are not always necessary. For some uses, the single sheet 8 of polyester or the like may be suitable and preferred. The width of the composite portion 23 can be varied, depending upon the nature of the materials used, the shape of the opening, etc. In any event, the configuration should preferably be such as to ensure that the membrane 2 is always removed completely, rather than being torn and leaving parts of it in place. It is also possible that other combinations of materials could be used, depending upon the application.

Figure 6:
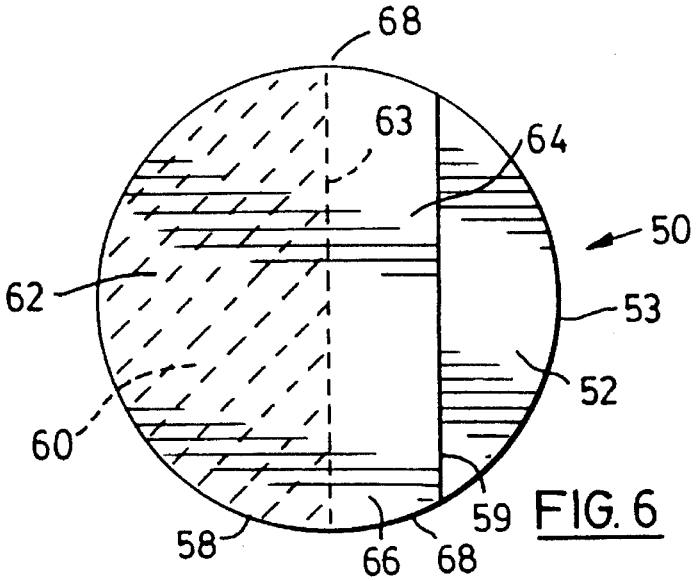
FIG. 6 is a plan view of a first embodiment of the present invention.
Figure 7:
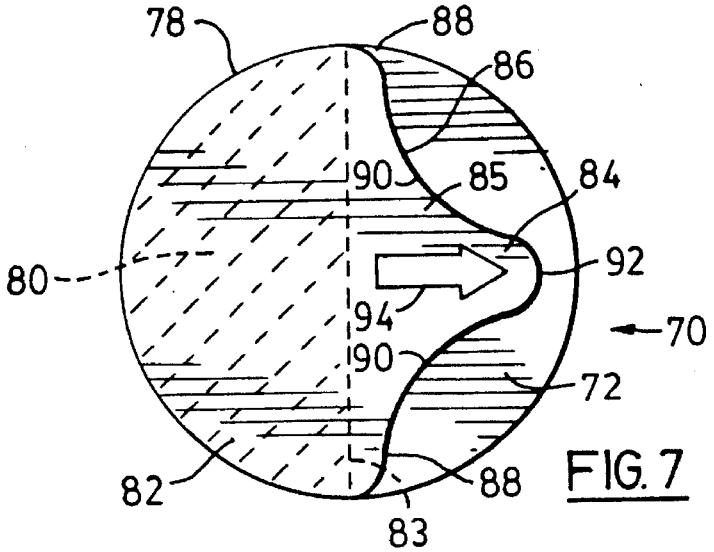
FIG. 7 is a plan view of a second embodiment of the present invention.
Figure 8:
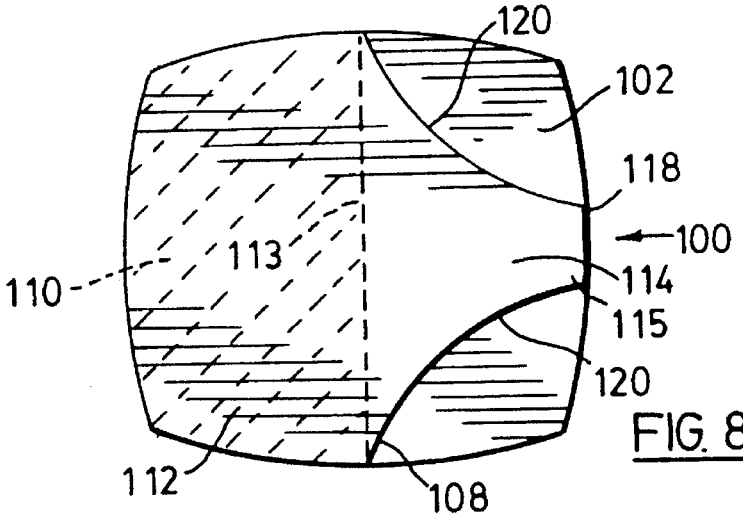
FIG. 8 is a plan view of a third embodiment of the present invention.

Whilst the embodiment of FIGS. 1–4 and 7 shows a tab with a free edge corresponding to the free edge of the membrane, the tab free edge or tab profile need not correspond exactly to the edge of the membrane. Instead, the tab can have various sizes and profiles. FIGS. 6, 7 and 8 show two further embodiments with different tab profiles.

In FIGS. 6, 7 and 8, there are shown three further embodiments of the sealing member. Each of these is shown as comprising a foil or membrane, a first layer of adhesive, and a first sheet bonded by the first layer of adhesive to the foil or membrane. There would additionally be a layer of hot melt bonding material on the under side of the foil or membrane, although this is not visible. In this version of the sealing member, it is preferred for the tab to be simply formed from a single or first sheet, without the further layer of adhesive 12 and second sheet 14. However, it will be appreciated that, for certain uses and applications, it may be desirable to provide such a second, reinforcing sheet.

Referring to FIG. 6, there is shown a second embodiment of the sealing member, generally ? by the reference 50. This second embodiment 50 has a membrane 62 which is generally circular. A first sheet 68 has a periphery, the majority of which is circular. However, on one side the first sheet 68 has a straight edge 69, so that the first sheet 68 is cut back from the periphery of the membrane 62.

As indicated by the hatching, a first layer of adhesive 70 bonds approximately half of the membrane 62 to a semicircular portion of the first sheet 68. This forms a composite portion 72 and a separated portion 74, separated along the line 73.

This leaves a free tab 66, which is bounded by the separation line 63 and the straight edge 59, and along either edge by two peripheral, curved edge portions 68, which are common with the periphery of the membrane 52. As the edge 59 is set back from the membrane periphery, indicated at 53, this facilitates grasping of the tab 66.

FIG. 7 shows a third embodiment. Here, as before, a membrane 72 is bonded by a first layer of adhesive 80 to a first sheet 78. A composite portion 82 is separated from the separated portion 84 by a separation line 83.

Here, in the composite portion, as before, the first sheet 78 and the membrane 72 are generally semicircular and have a common periphery.

In the separated portion 84, the membrane 72 again is generally semicircular, with its overall shape being circular.

The first sheet 78 however has a periphery indicated at 86 which is set back from the periphery of the membrane.

This periphery 86 has convex portions 88 at either side. These continue into concave portions 90, which in turn continue into a convex gripping part 92. It will be seen that the overall tab 85 is symmetrical but has a line perpendicular to the separation line 83.

This tab 85 has the advantage that its shape directs the user how to grasp the tab and the direction in which it should be pulled. To further make it clear to a user in which direction the tab 85 should be pulled, an arrow can be provided, as indicated at 94.

The concave portions 88 are shown as carving sharply inwardly from the periphery of the membrane 72. As a variant, the convex portions 88 could initially follow the periphery of the membrane 72, comparable to the curved edge portions 68 in FIG. 6.

FIG. 8 shows a third embodiment, generally designated by the reference numeral 100. Here, the sealing member 100 has a non-circular periphery. It generally has the shape of a rounded rectangle, i.e. a rectangle who's sides are slightly convex. Such a configuration is sometimes found on the top of containers for some creams, etc. e.g. petroleum jelly.

Here, the membrane 102 has the rounded rectangular shape and is bonded a first layer of adhesive 110 to a first sheet 108. A composite portion 112 is separated from the separated portion 114 along a separation line 113. In the composite portion 112, the first sheet 108 has a periphery common with that of the membrane 102, as in the other embodiments. It will be appreciated that, for some uses, it may not be necessary for the membrane and the first sheet have an entirely common periphery in the composite portion 112. Indeed, certain applications it may be necessary only for the first sheet and the membrane to have a common periphery in the composite portion, immediately adjacent the separation line 113.

In the separated portion 114, the first sheet 108 has a tab 115. The tab 115 has an edge portion 118 at its free end, which is common with the periphery of the membrane 102. This edge portion is continuous with two concave edge portions 120, which extend from the separation line 113. An arrow 94 as in FIG. 7 could be provided to indicate the direction in which the tab 115 should be pulled.

It will be appreciated that whilst various tab profiles have been described, the features of these various tab profiles could be combined in different ways. Thus, in the third embodiment of FIG. 7, the tab could extend to the periphery of the membrane, and have an edge portion, comparable to the end edge portion 115 in FIG. 8.

The materials used and method of manufacture for the embodiments of FIG. 6, 7 and 8 can generally follow that described in the first embodiment.

A principal difference in the method of manufacture is the necessity to form the tab profile, which is within the boundary or periphery of the membrane or foil. There are three separate methods by which this can be accomplished. There are two techniques which can be affected on the sheet from which the first sheet portions are cut, prior to the lamination of the first sheet with a membrane.

The first technique, prior to laminating the first sheet and the membrane together, a single cut or slit is simply formed in the first sheet, corresponding to the periphery of the tab that is not common with the membrane. Thus, for the FIG. 6 embodiment, a straight slit corresponding to the straight edge 59 would be cut, for each location from which a sealing member would be die cut. Then, after lamination of the first sheet with the membrane, when each sealing member is die cut, a sector of the first sheet material, bounded by the straight line 59 will be cut off from the first sheet and can simply be discarded as waste.

A similar technique could be used for the tab 85 of the FIG. 7 embodiment, where a cut would be formed in the first sheet stock material, corresponding to the periphery 86. For the FIG. 8 embodiment, it would be necessary to form two separate cuts, corresponding to the concave edges 120. Then, when the entire sealing member 100 is die cut, two free portions of the first sheet will be discarded as waste.

A second technique is a modification of the first, where instead of simply cutting a single slit, the entire portion of the first sheet to be cut and discarded as waste is cut from the first sheet prior to lamination of the first sheet stock with the membrane.

A third alternative for forming these embodiments in the sealing member is to laminate the first sheet stock and membrane together as before, and then die cut through the first sheet only, with a die who's depth of cut is carefully controlled. It would be selected in dependence upon the thickness of the first sheet and the membrane. By cutting just through the first sheet, with a die shaped to cut the portion or portions of the first sheet to be discarded, one would again affect removal of those portions of the first sheet to be discarded.

The cap used need not be a screw or even a circular cap. It could have plain side walls and a variety of shapes.

The sealing member can be sealed to a container by a variety of different techniques, e.g. a hot plate rather than induction heating. Further, an adhesive that does not require heating could be used.

We claim:

1. A sealing member adapted for securing to the lip around an opening of a container to close the container, the sealing member comprising:

(a) a membrane having a periphery, one side of which is for bonding to the lip of the container;

(b) a first sheet;

(c) a first layer of adhesive between the membrane and the first sheet bonding facing portions of the membrane and the first sheet together to form a composite portion, whilst leaving at least one portion of the first sheet free in a separated portion of the sealing member, the free portion of the first sheet forming a tab, wherein a portion of the free edge of the tab is located within the periphery of the membrane, wherein the composite portion extends up to a line extending across the membrane, the line being a straight boundary, and wherein a part of the periphery of the membrane bounding that portion of the membrane forming the composite portion is common with a corresponding part of the first sheet, the straight boundary between the tab and composite portion extending to the periphery of the membrane and first sheet, with the membrane and first sheet having a common periphery at ends of the boundary; and (d) an additional layer of adhesive on said one side of the membrane which is adapted for bonding to the lip of the container, with the first layer of adhesive bonding the first sheet and the membrane together so strongly that, in use, the first sheet and the membrane can be removed as a unit from the lip of the container to open the container.

2. A sealing member as claimed in claim 1, wherein the line extending across the membrane, and extends across a major portion of the membrane.

3. A sealing member as claimed in claim 2, wherein the composite portion covers a substantial portion of the membrane, and wherein the membrane has a perimeter portion adapted for bonding to the lip of the container, with the area of the composite portion being substantially greater than said perimeter portion of the membrane.

4. A sealing member as claimed in claim 3, wherein the first sheet and the membrane have common peripheral parts within said composite portion, with said line extending between said common peripheral parts.

5. A sealing member in combination with a cap, the cap comprises a cap body having a planar top wall and a side wall, wherein the sealing member is adapted for securing to the lip around an opening of a container to close the container, the sealing member comprising:

(a) a membrane having a periphery, one side of which is for bonding to the lip of the container;

(b) a first sheet;

(c) a first layer of adhesive between the membrane and the first sheet bonding facing portions of the membrane and the first sheet together to form a composite portion, whilst leaving at least one portion of the first sheet free in a separated portion of the sealing member, the free portion of the first sheet forming a tab, wherein a portion of the free edge of the tab is located within the periphery of the membrane, wherein the composite portion extends up to a line extending across the membrane, the line being a straight boundary and extending across a major portion of the membrane, and wherein a part of the periphery of the membrane bounding that portion of the membrane forming the composite portion is common with a corresponding part of the first sheet, the composite portion covering a substantial portion of the membrane, and the membrane having a perimeter portion adapted for bonding to the lip of the container, with the area of the composite portion being substantially greater that said perimeter of the membrane, the first sheet and the membrane including common peripheral parts within the separated portion; and (d) an additional layer of adhesive on said one side of the membrane which is adapted for bonding to the lip of the container, with the first layer of adhesive bonding the first sheet and the membrane together so strongly that, in use, the first sheet and the membrane can be removed as a unit from the lip of the container to open the container, wherein the sealing member is mounted in the cap with the side of the sealing member remote from the membrane facing an inner face of the planar top wall, ready for mounting on a neck of a container.

6. A sealing member as claimed in claim 5, wherein said common peripheral parts in the separated portion extend from the line dividing the composite and separated portions.

7. A sealing member as claimed in claim 6, wherein the common peripheral parts of the separated portion are convex.

8. A sealing member as claimed in claim 7, wherein the tab includes a straight edge extending between the common peripheral parts of the first sheet.

9. A sealing member as claimed in claim 7, wherein the convex peripheral parts of the first sheet, adjacent said line, are continuous with respective ones of a pair of concave peripheral parts, which in turn are continuous with a convex gripping portion.

10. A sealing member in combination with a cap, the cap comprises a cap body having a planar top wall and a side wall wherein the sealing member is adapted for securing to the lip around an opening of a container to close the container, the sealing member comprising:

(a) a membrane having a periphery, one side of which is for bonding to the lip of the container;

(b) a first sheet;

(c) a first layer of adhesive between the membrane and the first sheet bonding facing portions of the membrane and the first sheet together to form a composite portion, whilst leaving at least one portion of the first sheet free in a separated portion of the sealing member, the free portion of the first sheet forming a tab, wherein a portion of the free edge of the tab is located within the periphery of the membrane, wherein the composite portion extends up to a line extending across the membrane, the line being a straight boundary and extending across a major portion of the membrane, and wherein a part of the periphery of the membrane bounding that portion of the membrane forming the composite portion is common with a corresponding part of the first sheet, the composite portion covering a substantial portion of the membrane, and the membrane having a perimeter portion adapted for bonding to the lip of the container, with the area of the composite portion being substantially greater that said perimeter of the membrane, the tab including peripheral parts adjacent said line which are not common with the periphery of the membrane; and (d) an additional layer of adhesive on said one side of the membrane which is adapted for bonding to the lip of the container, with the first layer of adhesive bonding the first sheet and the membrane together so strongly that, in use, the first sheet and the membrane can be removed as a unit from the lip of the container to open the container, wherein the sealing member is mounted in the cap with the side of the sealing member remote from the membrane facing an inner face of the planar top wall, ready for mounting on a neck of a container.

11. A sealing member as claimed in claim 10, wherein the peripheral parts of said tab are substantially concave.

12. A sealing member as claimed in claim 11, wherein the concave peripheral parts of said tab are joined by an edge portion having a common periphery with the membrane.

13. A sealing member as claimed in claim 10, wherein the entire periphery of the tab is located within the periphery of the membrane.

14. A sealing member as claimed in claim 13, wherein the periphery of the tab is generally symmetrical with another line perpendicular to the said line separating the composite and separated portions, the tab periphery comprising convex parts extending from said first-mentioned line, continuous with concave parts, which in turn are continuous with a convex gripping part.

15. A sealing member as claimed in claim 8, 9, or 14, wherein the first sheet and the membrane include common peripheral parts within the composite portion.

16. A sealing member as claimed in claim 8 or 9, wherein the additional layer of adhesive comprises a hot melt bonding material and the membrane is formed from a metal foil which can be heated by induction heating to melt the hot melt bonding material, for bonding the sealing member to the lip of the container.

17. A sealing member adapted for securing to the lip around an opening of a container to close the container, the sealing member comprising:

(a) a membrane having a periphery, one side of which is for bonding to the lip of the container;

(b) a first sheet;

(c) a first layer of adhesive between the membrane and the first sheet bonding facing portions of the membrane and the first sheet together to form a composite portion, whilst leaving at least one portion of the first sheet free in a separated portion of the sealing member with a dividing line between the composite and separated portions, the free portion of the first sheet forming a tab, which tab includes a gripping portion remote from the dividing line and within the periphery of the membrane, wherein the dividing line is longer than the width of the gripping portion, and wherein a part of the periphery of the membrane bounding that portion of the membrane forming the composite portion is common with the corresponding part of the first sheet, the dividing line between the separated portion and the composite portion forming a straight boundary which extends to the periphery of the membrane and first sheet, with the membrane and first sheet having a common periphery at ends of the boundary; and (d) an additional layer of adhesive on said one side of the membrane which is adapted for bonding to the lip of the container, with the first layer of adhesive bonding the first sheet and the membrane together so strongly that, in use, the first sheet and the membrane can be removed as a unit from the lip of the container to open the container.

18. A sealing member as claimed in claim 17, wherein the separated portion includes common peripheral parts extending from the line dividing the composite and separated portions.

19. A sealing member as claimed in claim 18, wherein the common peripheral parts of the separated parts are convex, and a straight edge extends between the common peripheral parts of the first sheet.

20. A sealing member as claimed in claim 18, wherein the first sheet comprises in the separated portion, convex peripheral parts adjacent said line, respective ones of a pair of concave peripheral parts continuous therewith, which in turn are continuous with a convex gripping portion.

21. A sealing member as claimed in claim 17, wherein the tab includes peripheral parts adjacent said line which are not common with the periphery of the membrane and which are substantially concave.

22. A sealing member adapted for securing to the lip around an opening of a container to close the container, the sealing member comprising:

(a) a membrane having a periphery, one side of which is for bonding to the lip of the container;

(b) a first sheet;

(c) a first layer of adhesive between the membrane and the first sheet bonding facing portions of the membrane and the first sheet together to form a composite portion, whilst leaving at least one portion of the first sheet free in a separated portion of the sealing member, the free portion of the first sheet forming a tab, wherein a portion of the free edge of the tab is located within the periphery of the membrane, the composite portion extending up to a straight line extending across the membrane, the line being a straight boundary and all of the composite portion having a common periphery for the membrane and the first sheet, the straight boundary between the tab and composite portion extending to the periphery of the membrane and first sheet, with the membrane and first sheet having a common periphery at ends of the boundary; and (d) an additional layer of adhesive on said one side of the membrane which is adapted for bonding to the lip of the container, with the first layer of adhesive bonding the first sheet and the membrane together so strongly that, in use, the first sheet and the membrane can be removed as a unit from the lip of the container to open the container.

23. In combination with a cap for fitting to the neck of a container and comprising a cap body having a planar top wall and a side wall, a sealing member adapted for securing to the lip around a neck of a container to close the container, the sealing member comprising:

(a) a membrane having a periphery, one side of which is for bonding to the lip of the container;

(b) a first sheet;

(c) a first layer of adhesive bonding the facing portions of the membrane and the first sheet together to form a composite portion, whilst leaving at least one portion of the first sheet free in a separated portion of the sealing member, the free portion of the first sheet forming a tab, wherein a portion of the free edge of the tab is located within the periphery of the membrane, wherein the composite portion extends up to a straight line extending across a major portion of the membrane, wherein the composite portion covers a substantial portion of the membrane, wherein the membrane has a perimeter portion adapted for bonding to the lip of the container, with the area of the composite portion being substantially greater than said perimeter portion of the membrane, and wherein the first sheet and the membrane include common peripheral parts within the separated portion; and (d) an additional layer of adhesive on said one side of the membrane which is adapted for bonding to the lip of the container, with the first layer of adhesive bonding the first sheet and the membrane together so strongly that, in use, the first sheet and the membrane can be removed as a unit from the lip of the container to open the container; and wherein the sealing member is mounted in the cap with the side of the sealing member remote from the membrane facing an inner surface of the planar top wall of the cap, ready for mounting on a neck of a container.

24. A sealing member as claimed in claim 23, wherein the common peripheral parts of the separated portion are convex.

25. A sealing member as claimed in claim 24, wherein the tab includes a straight edge extending between the common peripheral parts of the first sheet.

26. A sealing member as claimed in claim 24, wherein the convex peripheral parts of the first sheet, adjacent said line, are continuous with respective ones of a pair of concave peripheral parts, which in turn are continuous with a convex gripping portion.

27. A sealing member as claimed in claim 22, wherein the tab includes peripheral parts adjacent said line which are not common with the periphery of the membrane.

28. A sealing member as claimed in claim 27, wherein the peripheral parts of the tab adjacent said line are substantially concave.

29. A sealing member as claimed in claim 28, wherein the concave peripheral parts of the tab are joined by an edge portion having a common periphery with the membrane.

30. A sealing member as claimed in claim 25, 26 or 29, wherein the first sheet and the membrane include peripheral parts within the composite portion.

31. A sealing member as claimed in claim 25, 26 or 29, wherein the additional layer of adhesive comprises a hot melt bonding material and the membrane is formed from a metal foil which can heated by induction heating to melt the hot melt bonding material, bonding the sealing member to the lip of the container.

* * * * *